United States Patent [19]

Hummel et al.

[11] Patent Number: 4,513,663

[45] Date of Patent: Apr. 30, 1985

[54] MECHANISM FOR VARYING THE AXIAL TRAVEL OF A DISTRIBUTING ROLLER IN A PRINTING MACHINE

[75] Inventors: Peter Hummel; Fred Kunkel, both of Offenbach, Fed. Rep. of Germany

[73] Assignee: M.A.N. Roland Druckmaschinen Aktiengesellschaft, Offenbach am Main, Fed. Rep. of Germany

[21] Appl. No.: 554,585

[22] Filed: Nov. 23, 1983

[30] Foreign Application Priority Data

Nov. 25, 1982 [DE] Fed. Rep. of Germany ..... 3243582

[51] Int. Cl.[3] ..... B41F 31/00; B41L 27/00

[52] U.S. Cl. ..... 101/349; 101/DIG. 14

[58] Field of Search ..... 101/348, 349, 350, 351, 101/352, DIG. 14, DIG. 6, 206–209, 148, 353, 356–358, 354, 355, 359–362

[56] References Cited

U.S. PATENT DOCUMENTS

| | | | |
|---|---|---|---|
| 1,291,068 | 1/1919 | Miehle | 101/DIG. 14 |
| 3,994,222 | 11/1976 | Pullen | 101/DIG. 14 |
| 4,040,347 | 8/1977 | Johne et al. | 101/DIG. 14 |

FOREIGN PATENT DOCUMENTS

| | | | |
|---|---|---|---|
| 556742 | 12/1974 | Switzerland | 101/DIG. 14 |

*Primary Examiner*—J. Reed Fisher

*Attorney, Agent, or Firm*—Leydig, Voit, Osann, Mayer & Holt, Ltd.

[57] ABSTRACT

A mechanism for axially reciprocating at least one of the distributing rollers of a printing press. A rocker having an elongated slot therein is mounted on a first pivot and oscillated thereabout by means of a link eccentrically connected to the press drive shaft. An oscillating lever is pivotally connected to the press frame for movement about a second pivot and includes a sliding block captively held in the elongated slot of the rocker. The oscillating lever is operatively connected to at least one of the distributing rollers so as to axially reciprocate the roller in response to the oscillation of the lever. The location of the first pivot is adjustable with respect to the press frame so as to change the orientation of the elongated slot in the rocker and, thus, vary the magnitude of travel of the oscillating lever which reciprocates the distributing roller. For such purpose, the first pivot is secured in one arm of a two-armed lever, the lever being pivotally connected to the frame. The second arm of the lever is secured to a traveling nut which is threaded on a shaft mounted for rotational movement with respect to the frame. Either a manually turnable knob or an electric motor is connected to the shaft so as to rotate the same, resulting in a rotation of the two-armed lever about its pivot to change the position of the first pivot held in the first arm of the lever.

9 Claims, 5 Drawing Figures

MECHANISM FOR VARYING THE AXIAL TRAVEL OF A DISTRIBUTING ROLLER IN A PRINTING MACHINE

This invention relates to a mechanism for varying the axial travel of a distributing roller or the like in a printing machine and, more particularly, is directed to a mechanism which permits easy adjustment of the amount of axial travel of a distributing roller while the press is operating.

In offset printing presses, it has proven desirable to axially reciprocate the distributing rollers in order to more uniformly transfer ink to the applicator rollers of the press. However, temperature fluctuations and the like encountered during the operation of the printing press can require adjustment of the amount of axial travel of the distributing roller before a particular press run is finished. If the press has to be shut down to adjust the travel, color variations and changes in the ink-water equilibrium in the press may result in inconsistent print quality between successive sheets. Consequently, it is desirable that the amount of travel of the distributing rollers be adjustable during the running of the printing press in order to reduce both the amount of down time for the press and the number of spoiled prints run before the optimum travel of the distributing roller is obtained. Further, if the travel of the distributing rollers can be adjusted during the operation of the press, such adjustment can be made immediately after comparison of successive proof sheets, thus even further reducing the number of spoiled pages.

Thus, it is the primary object of the instant invention to provide a mechanism which permits easy selectively, controlled adjustment of the amount of axial travel of the distributing rollers of a printing press during the operation of the press.

It is a further object to provide such a mechanism which has few parts and is of simple construction.

An additional object is to provide such a mechanism which may be adjusted either manually or automatically.

Other objects and advantages will become apparent upon reference to the following detailed description and accompanying drawings in which.

Figure 1:
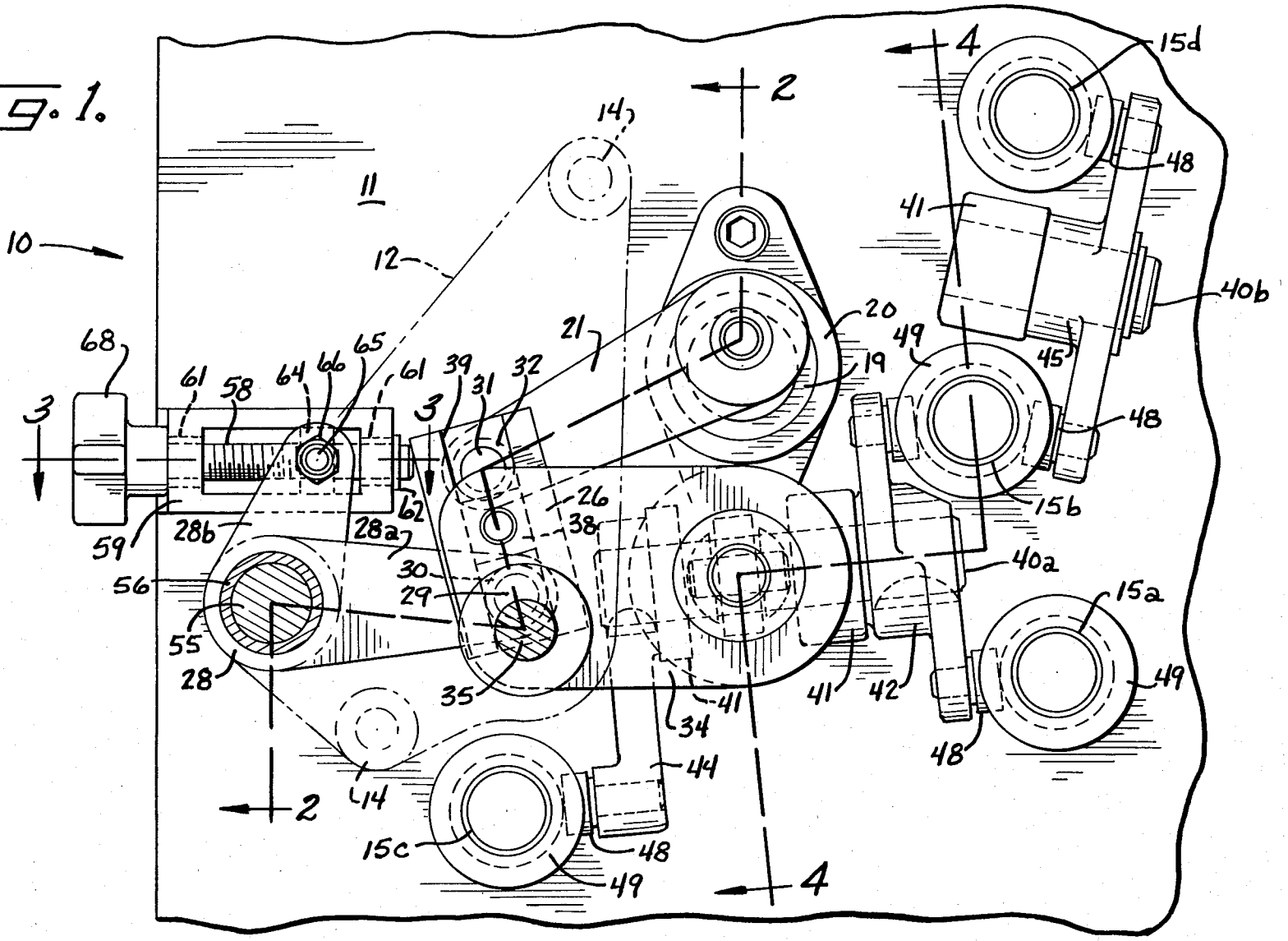
FIG. 1 is a side elevation of a portion of a printing press embodying the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the invention is to cover all modifications, alternative constructions and equivalents falling within the spirit and scope of the invention.

Figure 2:
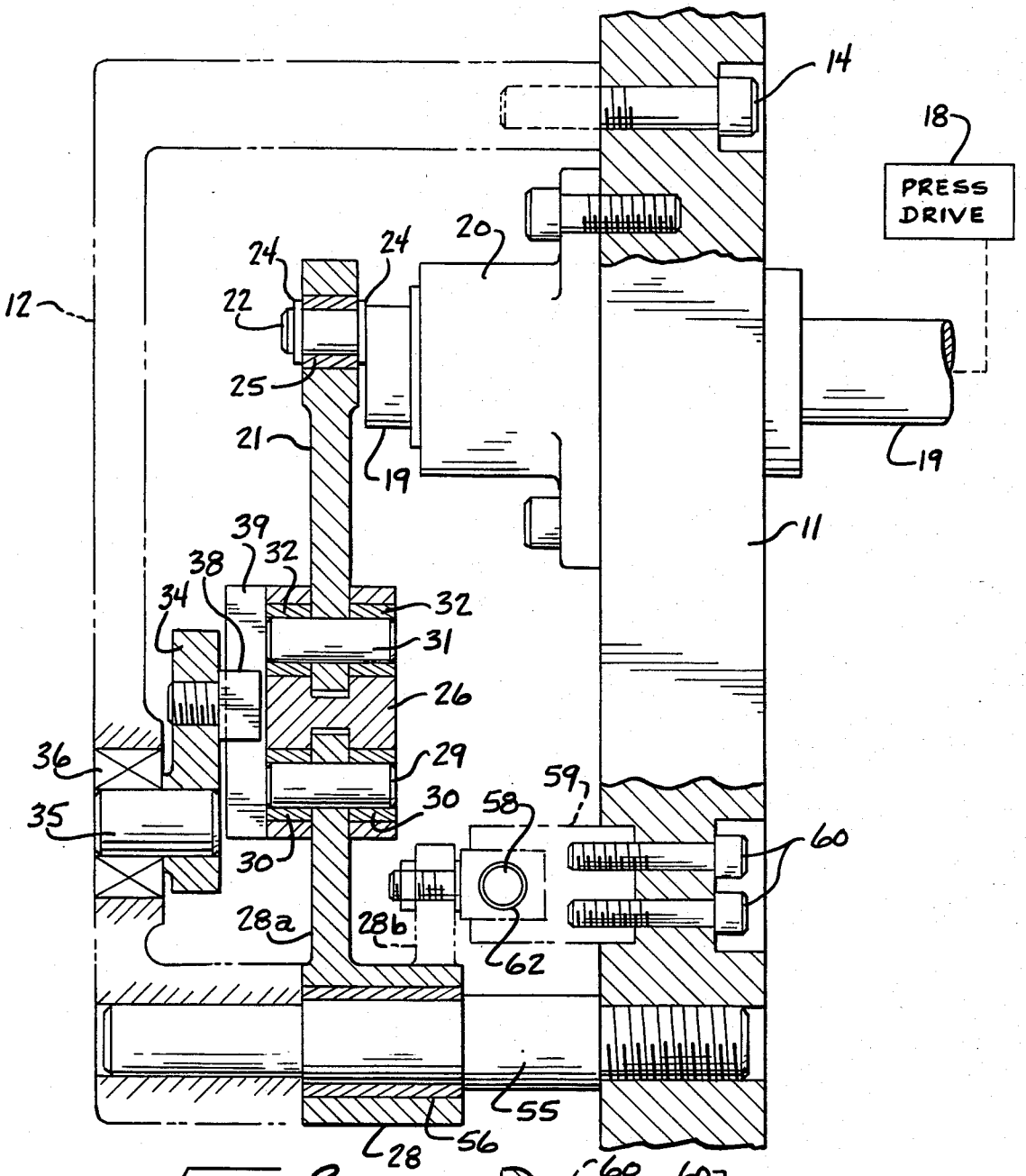
FIG. 2 is an enlarged section taken in the plane of line 2—2 in FIG. 1.
Figure 3:
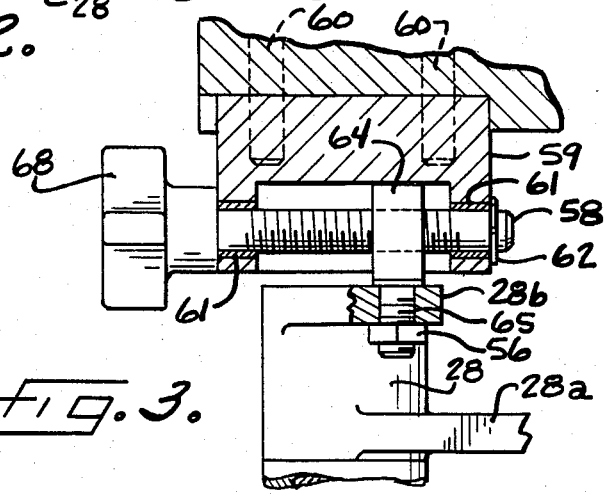
FIG. 3 is a fragmenting section view taken in the plane of line 3—3 in FIG. 1.
Figure 4:
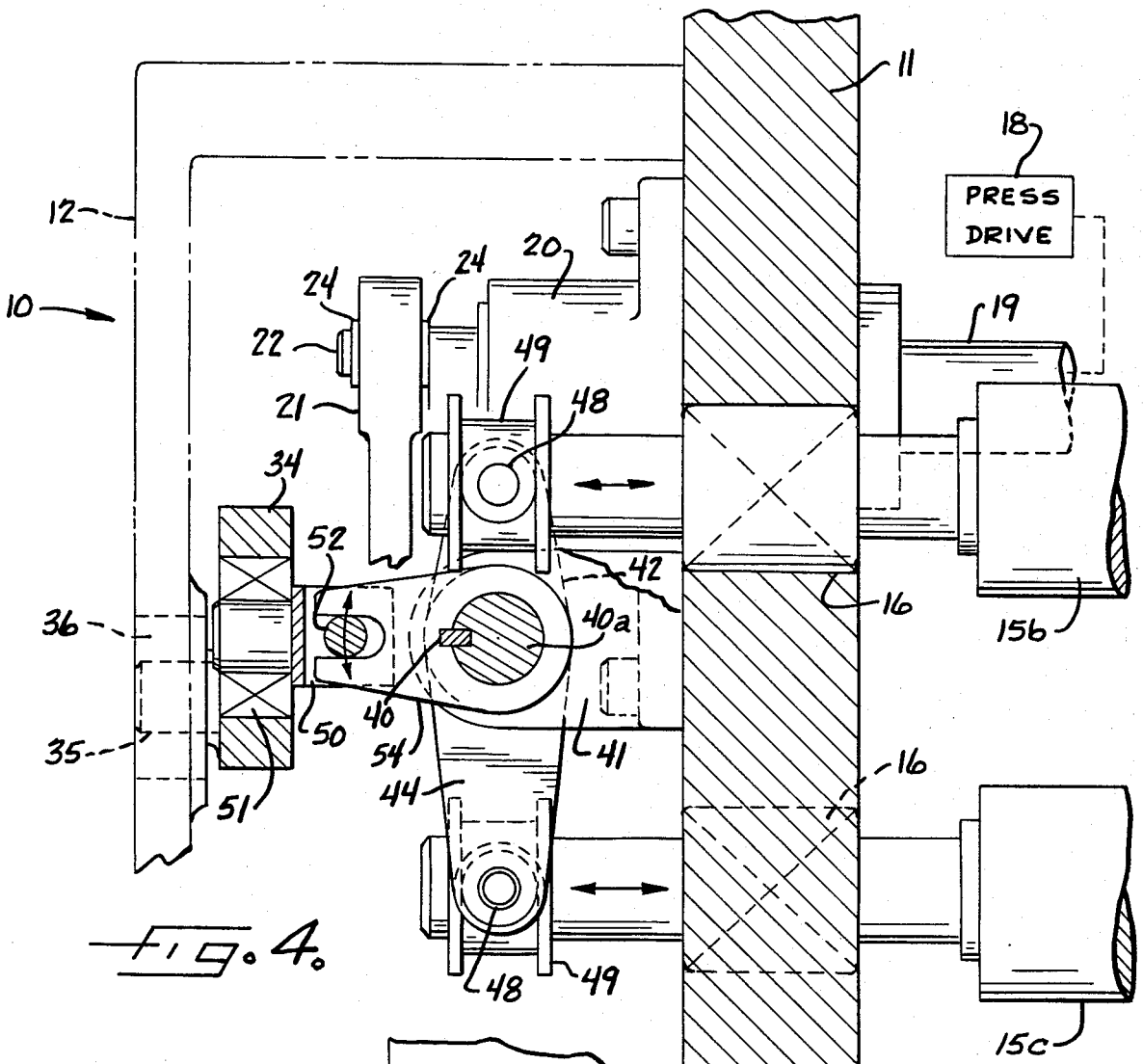
FIG. 4 is an enlarged section taken in the plane of line 4—4 in FIG. 1.

Referring to FIGS. 1, 2 and 4, there is shown an illustrative a printing press 10 embodying the present invention. The press 10 comprises a frame 11 which includes a side column or retaining plate 12 secured thereto by means of threaded bolts 14 (FIG. 2). Distributing rollers 15*a–d* are carried by the frame 11 by means of bearings 16, which permit both rotation and axial reciprocation of the distributing rollers (FIG. 4).

For axially reciprocating the distributing rollers 5*a–d*, a press drive 18 rotates a shaft 19 supported by a bushing 20 externally-mounted on the frame. A link 21 is eccentrically mounted to the end of the drive shaft 19 by a bolt 22, washers 24 and bushing 25, best seen in FIG. 2, so that the link 21 is pivotable with respect to the drive shaft 19. A rocker member 26 in turn is pivotally coupled to the end of the link 21, being mounted on a pin 31 carried on the end of the link 21 with bushings 32 interposed therebetween to facilitate relative movement. The rocker member 26 also is mounted for relative pivotal movement with respect to one arm 28*a* of a two-armed lever 28, being mounted on a first pivot or pin 29 fixedly held in the lever arm 28*a* with bushings 30 interposed therebetween.

A lever 34 is pivotally mounted in the side column 12 by means of a second pivot 35 and bearings 36. To oscillate the lever 34 about the axis of the second pivot 35, the lever 34 has a sled or block 38 which is captively held in an elongated slot 39 in the rocker 26. Hence, as the rocker 26 pivots about the axis of the first pivot 29 in response to the oscillation of the link 21 effected by rotation of the shaft 19, the lever 34 will oscillate about the second pivot 35 with the block 38 sliding back and forth in the slot 39.

The oscillating lever 34 is operatively connected to the rollers 15*a–d* such that the rollers are axially reciprocated as a result of oscillating movement of the lever 34. To this end, shafts 40*a* and 40*b* are rotatably supported in respective lugs 41 mounted on the frame 11. Referring to FIGS. 1 and 4, two levers 42, 44 are keyed to shaft 40*a* and a lever 45 is keyed to the shaft 40*b*. The levers 42, 44 and 45 are, in turn, operatively connected to the distributing rollers 15*a–d* by means of respective followers 48 which are mounted on the levers and ride in collars 49 disposed on the shafts of the distributing rollers 15*a–d*. To rotate the levers 42, 44 about the axis of shaft 40*a*, and thus oscillate the distributing rollers 15*a*, 15*b*, and 15*c*, the oscillating lever 34 carries a bracket 50, which in this case is rotatably supported in a bearing 51. Extending transversely from the bracket 50 is a stud 52 which is captured in the forks of a lever 54 fixed to the shaft 48 by means of a wedge or key 46. Thus, as the lever 34 oscillates, the stud 52 carried by the lever 34 will pivot the bracket 54 and shaft 40*a*. Consequently, the levers 42, 44, which are also attached to the shaft 40*a*, will oscillate, thus axially reciprocating the distributing rollers 15*a*, 15*b* and 15*c*. For oscillating the distributing roller 15*d*, the lever 45 will oscillate about its shaft 40*b* in response to the axial reciprocation of the distributing roller 15*b*.

In accordance with an important aspect of the invention, means are provided for selectively adjusting the magnitude of the axial reciprocation of the distributing rollers during operation of the press. More particularly, means are provided for selectively changing the location of the first pivot 29, and thereby, the manner in which the rocker member 26 acts on the lever 34 in response to driving movement of the link 21. In the illustrated embodiment, as can be best seen from viewing FIGS. 1 and 2, the amplitude of the reciprocating movement of the rocker 26 depends upon the location of the rocker pivot 29. Thus, the magnitude of the oscillations of the lever 34 can be varied by adjusting the location of the rocker pivot 29. To this end, the two-armed lever 28 is rotatably mounted on a support shaft 55. To rotate the lever 28 about the shaft 55, a threaded spindle 58 is captively mounted on the frame 11 by means of a bracket 59 secured to the frame 11 by bolts 60. The spindle 58 is rotatably maintained in the bracket 59 by means of bushings 61 and a snap ring 62. A traveling nut 64 is threadably received on the spindle 58 so as to be movable along the length of the spindle 58 in response to the rotation thereof. A threaded stud 65 extends from the nut 64 through the arm **28*b* of the lever 28 and is secured thereto by a nut 66. Thus, as the traveling nut 64 moves along the length of the threaded spindle 58 in response to rotation of the spindle, the lever arm 28*b*, and thus the lever 28, will rotate about the axis of the shaft 55. Consequently, the arm 28*a* of the lever 28 will rotate about the axis of the support shaft 55 to adjust the location of the rocker pivot 29**.

Figure 5:
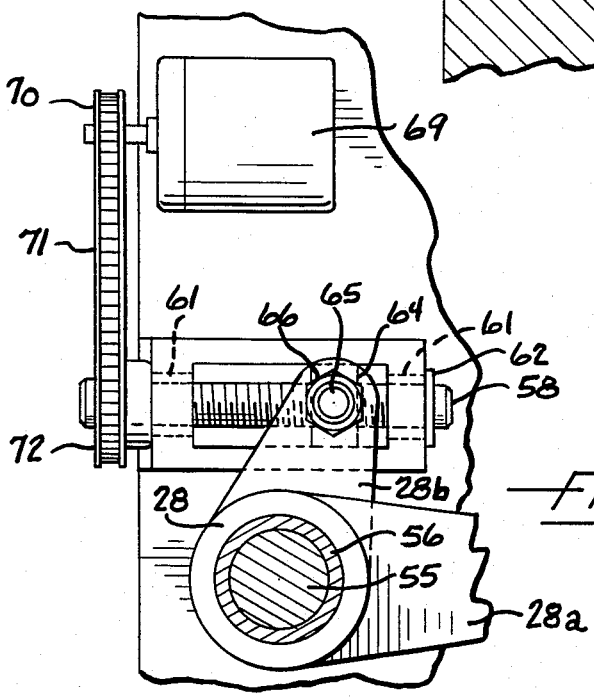
FIG. 5 is a partial view of printing press, similar to that shown in FIG. 1, showing an alternate embodiment of the invention.

To facilitate the manual rotation of the threaded spindle 58, a knob 68 is secured to the spindle 58 externally of the press frame. The knob 68 may have graduations thereon so that the press operator can adjust the location of the rocker pivot 29, and thus the magnitude of axial reciprocation of the distributor rollers **15*a–d*, in accordance with the operator's experience. Alternatively, as shown in FIG. 5, the adjustment of the position of the rocker pivot 29 can be carried out by means of a remotely controlled, selectively-operable electric motor 69 mounted on the machine frame 11. The motor 69 includes a sprocket 70 which drives an endless chain 71. To receive the chain 71, the threaded spindle 58 also includes a sprocket 72. In practice, the electric motor 70** may be numerically controlled by means of appropriately coded values recorded on a tape.

From the foregoing, therefore, it can be seen that the distributing roller controlling and adjusting mechanism of the present invention is adapted to permit easy adjustment of the amount of axial travel of the distributing rollers of a printing press during operation of the press. The mechanism also includes relatively few parts, so as to lend itself to economical construction, and is susceptible to either manual or automatic adjustment.

What is claimed is:

1. In a printing press having a frame and a press drive for rotating rollers therein, a mechanism for axially reciprocating at least one ink distributing roller of the press comprising, in combination, a first pivot mounted in selectively determined relation to said frame;

a rocker member pivotably mounted on said first pivot;

means for oscillating the rocker member about the first pivot;

a second pivot mounted in fixed relation to the frame;

an oscillating lever pivotably mounted on said second pivot;

means coupling said oscillating lever to said rocker member so that said lever is oscillated in response to oscillating movement of said rocker member;

means operatively connecting the oscillating lever to the distributing roller of the press for axially reciprocating the roller in response to the oscillation of the lever; and means for selectively adjusting the location of the first pivot with respect to the frame so as selectively alter the magnitude of travel of the oscillating lever and the reciprocation of the distributing roller.

2. The combination of claim 1 in which said rocker member is formed with an elongated slot, and said coupling means includes a slide member captively disposed in said rocker member slot for relative longitudinal movement.

3. The combination of claim 2 in which said adjusting means is operable to selectively vary the orientation of said elongated rocker member slot relative to said oscillating lever.

4. The combination of claim 1 wherein the adjusting means for the first pivot comprises a double armed lever pivotally mounted with respect to said frame and having first and second arms, said first pivot being disposed on said first arm, a threaded shaft rotatably supported with respect the frame, means for rotating said threaded shaft, and means operatively connecting a second arm of said double armed lever to the threaded shaft so that as the shaft is rotated, said double armed lever is rotated to change the position of the first pivot.

5. The combination of claim 4 wherein the means for rotating the threaded shaft includes a knob secured to the shaft and located externally of the press.

6. The combination of claim 4 wherein the means for rotating the threaded shaft includes a remotely-controlled, selectively-operable electric motor.

7. The combination of claim 1 wherein the means connecting the oscillating lever to the distributor roller includes a rotatable shaft, means for connecting the rotatable shaft to the oscillating lever, and a further lever secured to the shaft and operatively connected to the distributor roller.

8. The combination of claim 1 wherein the means for oscillating the rocker member includes a link pivotally connected to the rocker member and eccentrically connected to the press drive.

9. The combination of claim 7 including at least two distributing rollers, a second further rotatable lever operatively connected to both distributing rollers so that as the first distributing roller is reciprocated by means of the oscillating lever, the second further lever is rotated in response to such reciprocation and axially reciprocates the second distributing roller.

* * * * *